US008851940B2

(12) United States Patent
Friedhof et al.

(10) Patent No.: US 8,851,940 B2
(45) Date of Patent: Oct. 7, 2014

(54) MULTI-PIECE SOCKET CONTACT ASSEMBLY

(75) Inventors: James P. Friedhof, Vista, CA (US); Alex Robert Rengifo, Oceanside, CA (US); Giuseppe Bianca, Temecula, CA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 0 days.

(21) Appl. No.: 13/549,103

(22) Filed: Jul. 13, 2012

(65) Prior Publication Data

US 2014/0017960 A1 Jan. 16, 2014

(51) Int. Cl.
*H01R 13/187* (2006.01)

(52) U.S. Cl.
USPC ..... 439/843

(58) Field of Classification Search
USPC ..... 439/843, 851, 246; 148/432, 435; 29/876
See application file for complete search history.

(56) References Cited

U.S. PATENT DOCUMENTS

| | | | | | |
|---|---|---|---|---|---|
| 4,179,314 | A * | 12/1979 | Wikle | ..... | 148/685 |
| 4,599,120 | A * | 7/1986 | Church et al. | ..... | 148/414 |
| 4,780,097 | A * | 10/1988 | Piscitelli | ..... | 439/843 |
| 5,090,116 | A * | 2/1992 | Henschen et al. | ..... | 29/827 |
| 6,001,196 | A * | 12/1999 | Harkness et al. | ..... | 148/435 |
| 6,183,885 | B1 * | 2/2001 | Nakamura et al. | ..... | 428/647 |
| 6,250,974 | B1 * | 6/2001 | Kerek | ..... | 439/843 |
| 6,264,508 | B1 * | 7/2001 | Lehmann | ..... | 439/843 |
| 6,475,039 | B1 * | 11/2002 | Despouys | ..... | 439/843 |
| 6,585,833 | B1 * | 7/2003 | Ordillas | ..... | 148/432 |
| 6,994,600 | B2 * | 2/2006 | Coulon | ..... | 439/843 |
| 8,496,504 | B2 * | 7/2013 | Ono et al. | ..... | 439/877 |
| 2004/0229490 | A1 * | 11/2004 | Bernat et al. | ..... | 439/246 |
| 2011/0028039 | A1 | 2/2011 | Haangaertner et al. | | |

OTHER PUBLICATIONS

International Search Report, International Application No. PCT/US2013/049834, International Filing Date, Jul. 10, 2013.

* cited by examiner

*Primary Examiner* — Alexander Gilman
(74) *Attorney, Agent, or Firm* — O'Melveny & Myers LLP

(57) ABSTRACT

A system and method is provided for securing a spring body against a socket body, thereby reducing movement of the spring body during periods of vibration. Preferred embodiments of the present invention operate in accordance with a socket body that includes at least a proximal end, a spring body that includes at least a distal end, and a sleeve. In one embodiment of the present invention, the distal end of the spring body is configured to be placed over the proximal end of the socket body, and the sleeve is configured to be placed over the distal end of the spring body. The sleeve preferably includes an inner circumference that is sized to creating a frictional engagement between an inner surface of the sleeve and an outer surface of the spring body, and between an inner surface of the spring body and an outer surface of the socket body.

17 Claims, 4 Drawing Sheets

MULTI-PIECE SOCKET CONTACT ASSEMBLY

BACKGROUND OF THE INVENTION

1. Field of the Invention

The present invention relates to a socket contact assembly, or more particularly, to an assembly that includes a spring body formed out of a first material, a socket body formed out of a second material, and a sleeve configured to secure the spring body to the socket body, thereby at least reducing movement of the spring body in relation to the socket body during periods of vibration.

2. Description of Related Art

Connectors are used in many applications, including commercial, consumer and military applications. Connectors are typically used to transmit information (e.g., a voltage, current, etc.) from a first device to a second device. For example, a connector may be used to provide power from a power supply to a circuit. By way of another example, a connector may be used to provide analog and/or digital information from a first circuit to a second circuit.

In order to ensure electrical continuity in a connector, connectors are commonly formed out of a single piece of material. However, there are drawbacks associated with using the same material to manufacture an entire connector. For example, in manufacturing a socket contact, the front (or proximate) end must have high yield strength to avoid permanent deformation when the socket fingers are deflected (e.g., during mating with a corresponding pin), and the back (or distal) end must be very ductile to allow permanent deformation without cracking (e.g., during crimping around a conductor). Because materials that have a high yield strength are (generally) not very ductile, and visa versa, it is difficult to manufacture an optimal socket contact out of a single piece of material.

In an effort to overcome this drawback, a prior art multi-piece socket contact assembly has been manufactured. Such a socket contact includes two pieces, i.e., a socket body and a spring body. During assembly, the spring body is press-fit onto the socket body. The drawback of such an assembly, however, is that during periods of high vibration, the spring body has a tendency to move in relation to the socket body. While the movement may be minimal (e.g., not resulting in the disassembly of the socket contact), it can be enough to cause fretting, or friction, which can create of a non-conductive barrier. If a non-conductive barrier is formed, the electrical continuity of the conductor is compromised.

In light of the foregoing, it would be advantageous to manufacture a multi-piece socket contact assembly that overcomes at least some of these drawbacks.

SUMMARY OF THE INVENTION

The present invention provides a multi-piece socket contact assembly that functions to secure a spring body against a socket body, thereby preventing (or reducing) movement of the spring body during a period of vibration. Preferred embodiments of the present invention operate in accordance with an assembly that includes a socket body, a spring body, and a sleeve.

In one embodiment of the present invention, the assembly includes a socket body that is formed out of a first material, and preferably out of a single piece of the first material. While the first material can be any conductive material, it is preferably one that is very ductile, and allow permanent deformation without cracking. In one embodiment of the present invention, the socket body includes a distal end and a proximal end, wherein the proximal end has a substantially circular outer surface, and the distal end is configured to be connected (e.g., crimped, etc.) to an external conductor.

In one embodiment of the present invention, the assembly further includes a spring body that is formed out of a second material, and preferably out of a single piece of the second material. While the second material can be any conductive material, it is preferably one that is different than the first material and has a high yield strength to avoid permanent deformation when deflected. In one embodiment of the present invention, the spring body includes a distal end and a proximal end, wherein the distal end includes a plurality of tines, and the proximal end includes a female connector (e.g., a plurality of fingers, etc.) that is configured to receive a male connector (e.g., a male pin, etc.). In a preferred embodiment of the present invention, the tines are configured to be placed over the proximal end of the socket body. Thus, for example, the tines may form at least one inner circumference that is either slightly larger than an outer circumference of the proximal end of the socket body, or slightly smaller than an outer circumference of the proximal end of the socket body. In the prior, the tines can be pressed over the proximal end of the socket body with a lesser amount of force, resulting in a lesser amount of frictional engagement between the spring and socket bodies. In the latter, the tines can be pressed over the proximal end of the socket body with a greater amount of force (e.g., as necessary to flex the tines in an outward direction), resulting in a greater amount of frictional engagement between the spring and socket bodies.

In one embodiment of the present invention, the assembly further includes a sleeve that includes at least one inner circumference that is sized to secure the spring body against the socket body. For example, the inner circumference of the sleeve may be equal to or slightly larger than the sum of the outer circumference of the proximal end of the socket body and the thickness of two opposing tines. In a preferred embodiment, the sleeve is pressed over the distal end of the spring body, thereby creating a frictional engagement between an inner surface of the sleeve and at least one outer surface of the distal end of the spring body, and between at least one inner surface of the distal end of the spring body and an outer surface of the proximal end of the socket body. By sandwiching (or compressing) the spring body between the sleeve and the socket body, a frictional force (or engagement) can be created that prevents (or at least reduces) movement of the spring body in relation to the socket body during periods of vibration.

In one embodiment of the present invention, the sleeve may further include at least one indent that can be used to provide a frictional (vertical) force against the spring body and/or a (horizontal) securing member for the spring body.

In another embodiment of the present invention, the inner circumference of the sleeve is slightly greater than the sum of the outer circumference of the proximal end of the socket body and the thickness of two opposing tines. In this embodiment, at least one tine is bent, and the sleeve secures the spring body in place by flexing the bent portion of the tine inward. By apply pressure on, and flexing the bent portion of the tine, additional frictional force can be applied between the spring body and the socket body, thereby securing the spring body against the socket body.

In yet another embodiment of the present invention, the spring body is electroplated with a conductive material (e.g., gold, etc.) while the spring body is in a relatively flat configuration (e.g., before it is configured into the relatively circular spring body used in the present invention).

A more complete understanding of a system and method for manufacturing and assembling a socket contact will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a multi-piece socket contact assembly that functions to reduce movement of a spring body in relation to a socket body during Periods of vibration. In the detailed description that follows, like element numerals are used to describe like elements illustrated in one or more figures.

Figure 1:
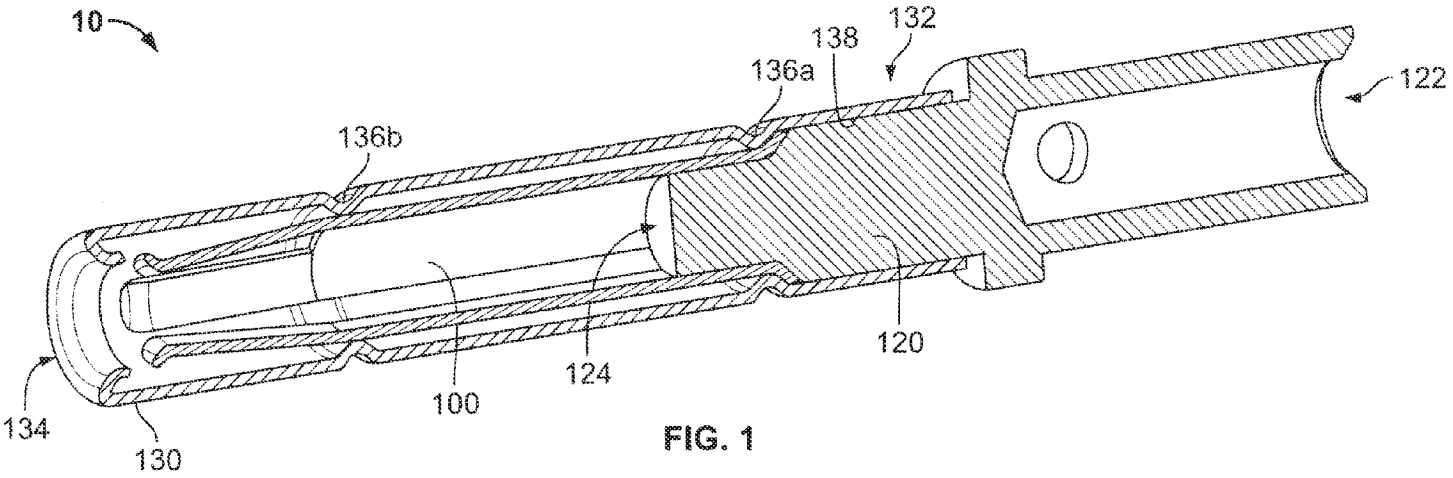
FIG. 1 illustrates a socket contact assembly in accordance with one embodiment of the present invention, comprising a socket body, a spring body, and a sleeve.

A socket contact assembly in accordance with one embodiment of the present invention is shown in FIG. 1. Specifically, the assembly 10 includes a socket body 120 that is formed out of a first material, and preferably out of a single piece of the first material. While the first material can be any conductive material, it is preferably one that is very ductile, and allow permanent deformation without cracking (e.g., brass, leaded nickel copper, gold, etc.). In one embodiment of the present invention, the socket body includes a distal end 122 and a proximal end 124, wherein the proximal end is solid and has a substantially circular outer surface, and the distal end 122 is configured to be connected to an external conductor (not shown). By way of example, the distal end 122 of the socket body 120 may include a crimp barrel configured to be crimped around the external conductor. It should be appreciated that the present invention is not limited to the socket body shown in FIG. 1, and may include, for example, a proximal end that is hollow (see, e.g., FIGS. 5 and 6), and/or a distal end that includes a solder cup instead of a crimp barrel.

Figure 2:
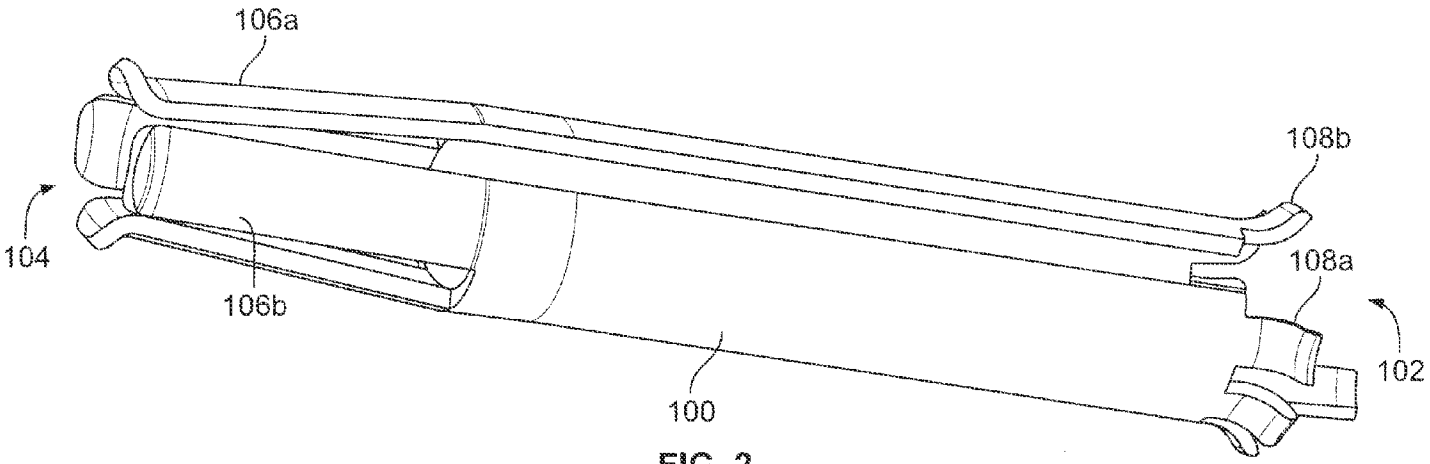
FIG. 2 shows the spring body of the socket contact assembly illustrated in FIG. 1.

The assembly shown in FIG. 1 further includes a spring body 100 that is formed out of a second material, and preferably out of a single piece of the second material. While the second material can be any conductive material, it is preferably one that is (i) different than the first material (i.e., the material used to form the socket body) and (i) has a high yield strength to avoid permanent deformation when deflected (e.g., phosphor bronze, beryllium copper, leaded nickel copper, electroplated steel, etc., anyone of which may further be processed by cold-working and/or age-hardening to improve its yield strength and spring properties). In other words, the second material should have good spring properties, including high strength, high elastic limit, and low modulus of elasticity. As shown in FIG. 2, the spring body 100 includes a distal end 102 and a proximal end 104, wherein the distal end 102 includes a plurality of tines (e.g., 108*a*, 108*b*, etc.), and the proximal end 104 includes a plurality of fingers (e.g., 106*a*, 106*b*, etc.).

Figure 3:
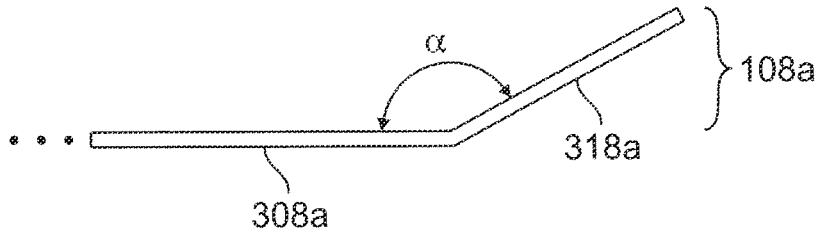
FIG. 3 illustrates a portion of the spring body (e.g., a tine) illustrated in FIG. 2.
Figure 4:
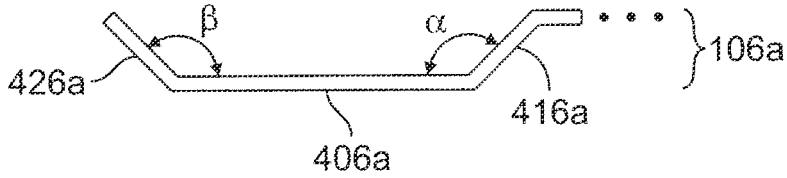
FIG. 4 illustrates another embodiment of a portion (e.g., a tine) of a spring body.

In one embodiment of the present invention, as shown in FIG. 3, at least one tine 108*a* includes a first portion 308*a*, a second portion 318*a*, and an angle $\alpha$ therebetween. In another embodiment of the present invention, as shown in FIG. 4, at least one finger 106*a* includes a first portion 406*a*, a second portion 416*a*, a first angle $\alpha$ therebetween, a third portion 426*a*, and a second angle $\beta$ between the first and third portions. As will be described in greater detail below, an indent in a sleeve may work in conjunction with at least one the foregoing portions/angles to secure the spring body against the socket body.

It should be appreciated that the distal end 102 of the spring body 100 (e.g., the plurality of tines) may form at least one inner circumference that is either slightly larger than an outer circumference of the proximal end 124 of the socket body 120, or slightly smaller than an outer circumference of the proximal end 124 of the socket body 120. In the prior, the distal end 102 of the spring body 100 can be press-fit over the proximal end 124 of the socket body 120 with a lesser amount of force, resulting in a lesser amount of frictional engagement between the spring and socket bodies. In the latter, the distal end 102 of the spring body 100 can be press-fit over the proximal end 124 of the socket body 120 with a greater amount of force (e.g., as necessary to flex the tines in an outward direction), resulting in a greater amount of frictional engagement between the spring and socket bodies. It should be appreciated that the present invention is not limited to an assembly that includes a plurality of tines on a distal end of a spring body. As long as the distal end of the spring body is configured to mate with (e.g., go over, go inside, etc.) a proximal end of the socket body, such an assembly would be within the spirit and scope of the present invention.

As discussed above, the proximal end 104 of the spring body 100 includes a plurality of fingers (e.g., 106*a*, 106*b*, etc.). In one embodiment of the present invention, the fingers (e.g., 106*a*, 106*b*, etc.) are configured to flex outward during insertion of an external male pin or connector (not shown). It should be appreciated, however, that the present invention is not limited to an assembly that includes a plurality of fingers on a proximal end of a spring body. As long as the proximal end of the spring body is configured to mate with an external conductor, such an assembly would be within the spirit and scope of the present invention.

As shown in FIG. 1, the assembly 10 further includes a sleeve 130 that includes a distal end 132 and a proximal end 134, wherein the proximal end 134 is configured to limit the size of the external male pin that the assembly 10 will accept. This is done by designing the proximal end 134 of the sleeve 130 to include an inner circumference that is equal to the largest diameter of the external male pin that the assembly 10 is willing to accept. The distal end 132 of the sleeve 130 includes at least one inner circumference. In one embodiment of the present invention, the inner circumference is sized to be equal to or slightly larger than the sum of the outer circumference of the proximal end 124 of the socket body 120 and the thickness of two opposing tines. By doing this, the sleeve can be press-fit over the distal end 102 of the spring 100, thereby (i) protecting the spring body 100 and/or (ii) creating a frictional engagement between an inner surface of the sleeve 130 and at least one outer surface of the distal end 102 of the spring body 100, and between at least one inner surface of the distal end 102 of the spring body 100 and an outer surface of the proximal end 124 of the socket body 120. By sandwiching (or compressing) the spring body 100 between the sleeve 130 and the socket body 120, a frictional force (or engagement) can be created that prevents (or at least reduces) movement of the spring body in relation to the socket body during a period of vibration. It should be appreciated, however, that the sleeve may include more than one inner circumference. For example, as shown in FIG. 1, the sleeve may include a first inner circumference at a proximal end of the sleeve (e.g., for limiting the size of the mail pin that can accepted), a second inner circumference at a distal end of the of the sleeve (e.g., equal to the outer circumference of a middle portion of the socket body, allowing a distal end of the sleeve to be press-fit over the middle portion of the socket body), and third inner circumference between the proximal and distal ends of the sleeve (e.g., to create frictional engagement between an inner surface of the sleeve and an outer surface of the distal end of the spring body).

Figure 5:
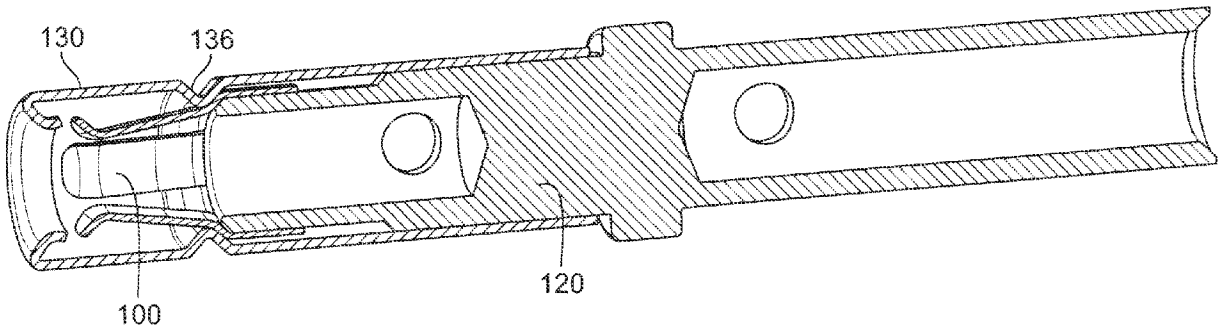
FIG. 5 illustrates a socket contact assembly in accordance with another embodiment of present invention, comprising a socket body, a spring body, and a sleeve.

In one embodiment of the present invention, the sleeve 130 may further include at least one indent that can be used to provide a frictional (vertical) force against the spring body and/or a (horizontal) securing member for the spring body. For example, as shown in FIG. 1, an indent 136*a* may be used to create the inner surface (or circumference) of the sleeve 130 that secures (or frictionally engages) the spring body 100 to the socket body 120. Further, or alternatively, the indent 136*a* may be used to define a securing member, preventing the second portion of at least one tine (see FIG. 3 at 318*a*) from moving in a horizontal direction. By way of another example, as shown in FIG. 5, an indent 136 may be used to define a securing member, preventing the second portion of at least one finger (see FIG. 4 at 416*a*) from moving in a horizontal direction. It should be appreciated that the present invention is not limited to the foregoing embodiments. For example, an indent that is used for generating a frictional force, for defining an obstacle for a portion of at least one tine, for defining an obstacle for a portion of at least one finger, or any combination thereof, is within the spring and scope of the present invention. It should also be appreciated that an indent can also be used for other features. For example, in FIG. 1, an indent 136*b* is used to prevent the plurality of finger from being overextended, or over-flexed in an outer direction.

As discussed earlier, the socket body is preferably formed out of a first material (e.g., one that is very ductile), and the spring body is formed out of a second material (e.g., one that has a high yield strength). The first material may vary, however, depending upon how the socket body is constructed. For example, the socket body shown in FIG. 1 is solid on the proximal end, and will therefore retain its shape even if the first material is very ductile (e.g., allowing the distal end can be crimped). The socket body shown in FIG. 5, however, is hollow on the proximal end, and therefore needs to be less ductile (or harder) to retain its shape (e.g., substantially circular). If the material used to form the socket body is less ductile, then it may be necessary to modify the distal end of the socket body to be more ductile (e.g., so that the distal end can be crimped). This can be accomplished, for example, by exposing the distal end of the socket body to an induction heating/water quenching process. It should be appreciated, however, that the present invention is not limited to such a process, and other processes generally known to those skilled in the art (i.e., known processes (e.g., annealing) for making a material more ductile) are within the spirit and scope of the invention.

Figure 6:
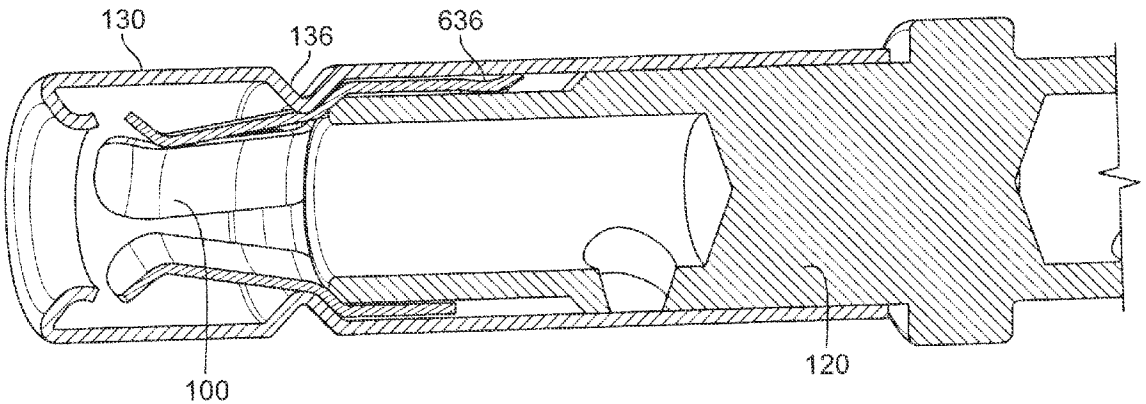
FIG. 6 illustrates a socket contact assembly in accordance with another embodiment of the present invention, comprising a socket body, a spring body, and a sleeve.
Figure 7:
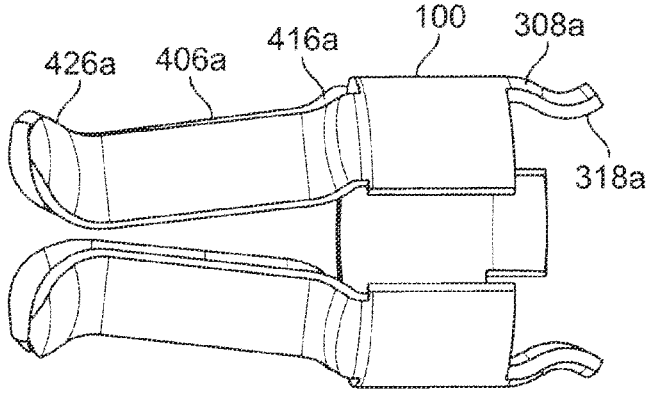
FIG. 7 shows a spring body of the socket contact assembly illustrated in FIG. 6.

In another embodiment of the present invention, as shown in FIG. 6, the inner circumference of the sleeve is slightly greater than the sum of the outer circumference of the socket body and the thickness of two opposing tines. In this embodiment, the sleeve secures the spring body in place by flexing the second portion of the tine inward, producing an angle (see, e.g., FIG. 3 at $\alpha$) that is greater when assembled than when disassembled. By apply pressure on, and flexing the second portion of the tine, additional frictional force can be applied between the spring body and the socket body, thereby securing the spring body against the socket body. It should be appreciated that the spring body is not limited to the portions/angles shown in FIGS. 3 and 4. For example, the spring body 100 shown in FIG. 7, which includes tines and fingers that are curved, is within the spirit and scope of the present invention. In such an embodiment, the socket body and sleeve would either be curved correspondingly (e.g., as shown in FIG. 1), or configured to use the curves (or a portion thereof) to secure the spring body to the socket body (e.g., as shown in FIG. 5).

Figure 8:
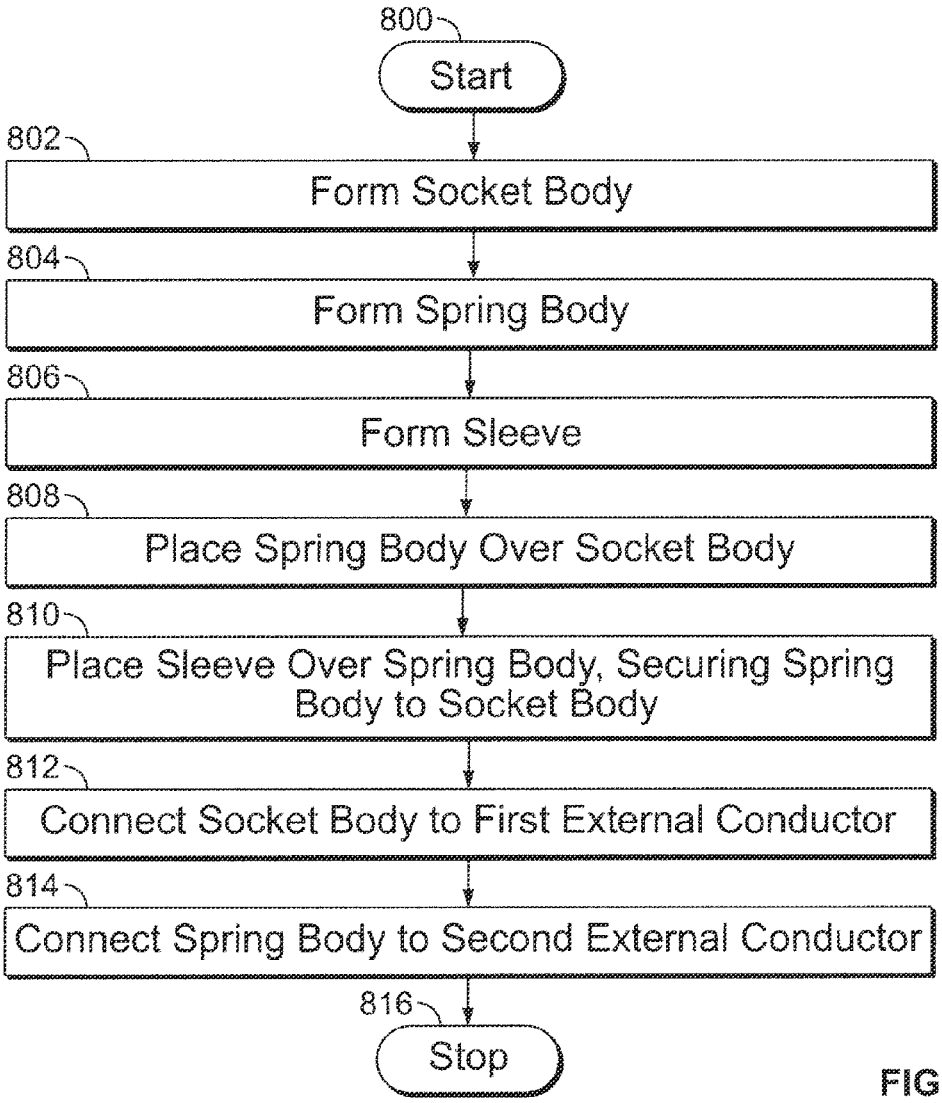
FIG. 8 illustrates a method of assembly a socket contact assembly, and connecting it to first and second external conductors.

In one embodiment of the present invention, the socket contact can be manufactured and assembled by hand and/or by machine. By way of example, as shown in FIG. 8, and starting at step 800, a socket body can is formed out of a first material (e.g., one that is very ductile) at step 802, and preferably out of a single piece (e.g., a single molded piece, etc.) of the first material. The spring body is then formed out of a second material (e.g., one that has a high yield strength) at step 804, and preferably out of a single piece (e.g., a single machined piece, etc.) of the second material. A sleeve is then formed at step 806. The distal end of the spring body is then placed (e.g., press-fit) over a proximal end of the socket body at step 808. The sleeve is then placed (e.g., press-fit) over the spring body at step 810, securing the spring body onto the socket body. Once the socket contact is assembled, the socket body can then be connected (e.g., crimped, soldered, etc.) to an external conductor at step 812, and the spring body can then be connected (e.g., press-fit, etc.) to an external male pin at step 814, ending the process at step 816.

While the foregoing provides descriptions of how a socket contact can be manufactured and assembled, it does not address the issue of electroplating, or drawbacks related thereto. For example, in the prior art, the proximal end of the spring body is generally electroplated with gold. However, this often results in gold plating on both contact and non-contact surfaces of the spring body. However, given that gold only has to be plated on contact surfaces (e.g., to comply with military standards, etc.), and gold is a precious and expensive commodity, it would be advantageous to design a socket contact that only includes gold plating (or an industry standard amount thereof) on contact surfaces. The present invention does this by electroplating the spring body before it rolled into the form shown in FIGS. 1, 2 and 5-7. Specifically, as described above, the spring body of the present invention can be constructed out of a single piece of material (e.g., a single piece of flat stock that is machined and then rolled).

In a preferred embodiment of the present invention, the flat stock is plated (e.g., overall, etc.) with nickel and plated (e.g., on an inner surface, on a portions of the inner surface that will come into contact with an external male pin and the proximal end of the socket body, etc.) 5 microinches of gold. Then a 45 microinches gold band is plated on one side (e.g., an inner surface) of one end (e.g., the proximal end, on a portion that will come into contact with an external male pin, etc.) of the flat stock. The flat stock is then rolled (or formed into the shapes generally illustrated in FIGS. 1 and 2 (e.g., substantially circular, etc.)), resulting in 50 microinches of gold plating on one side of one end of the spring body (e.g., on the inside of the proximal end of the spring body). It should be appreciated that the present invention is not limited to the foregoing plating method, and various steps can be modified or deleted without deviating from the present invention. For example, a substantially flat piece of material that is electroplated with an industry standard amount of conductive material on one side and one end before it is rolled (e.g., producing a conductive band having a width corresponding to a conductive surface of the finished product, etc.), is within the spirit and scope of the present invention.

Having thus described several embodiments of a system and method for manufacturing and assembling a socket contact, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A socket contact assembly, comprising:

a socket body comprising a proximal end and a distal end, wherein the distal end is configured to be connected to a conductor, and the proximal end includes at least an outer surface;

a spring body comprising a proximal end and a distal end, wherein the proximal end includes a female connector and the distal end includes a plurality of tines; and a sleeve including at least one indent that includes at least one inner surface;

wherein the female connector of the spring body is configured to be connected to an external male connector, the plurality of tines are configured to be placed over the proximal end of the socket body, so that the plurality of tines are in communication with the outer surface of the proximal end of the socket body, the sleeve is configured to (i) be secured to at least one of the distal end of the spring body and the socket body and (ii) secure the spring body onto the socket body by frictionally engaging the plurality of tines between the outer surface of the proximal end of the socket body and the at least one inner surface of the sleeve, and the at least one indent prevents the plurality of tines, which are at least partially angled in relation to the proximal end of the spring body, from moving in relation to the proximal end of the socket body.

2. The socket assembly of claim 1, wherein the distal end of the socket body is configured to be crimped around the conductor.

3. The socket assembly of claim 1, wherein the proximal end of the socket body is solid, and the outer surface of the proximal end of the socket body is substantially cylindrical.

4. The socket assembly of claim 1, wherein the proximal end of the socket body is hollow, and configured to receive at least a portion of the external male connector.

5. The socket assembly of claim 1, wherein the proximal end of the spring body includes a plurality of fingers that are biased in a first configuration having a first circumference, and are forcibly moved into a second configuration having a second circumference by the external male connector, the second circumference being larger than the first circumference.

6. The socket assembly of claim 5, wherein a proximal end of the sleeve is configured to prevent said plurality of fingers from being forcibly moved into a configuration having a circumference larger than said second circumference.

7. The socket assembly of claim 1, wherein at least one of the plurality of tines prior to the assembly of the sleeve over the distal end of the spring body includes a primary portion, a secondary portion, and a first angle formed on an outer surface therebetween, wherein the secondary portion of the at least one of the plurality of tines is bent as a result of the assembly of the sleeve over the distal end of the spring body, thereby resulting in a second angle therebetween, the second angle being greater than the first angle.

8. The socket assembly of claim 1, wherein the spring body and the socket body are made from different materials.

9. The socket assembly of claim 1, wherein the socket body is made from a first material and the spring body is made from a second material, the first material is more ductile than the second material, and the second material has at least one of a higher elastic limit and a lower modulus of elasticity than the first material.

10. The socket assembly of claim 9, wherein the first material is one of brass and leaded nickel copper.

11. The socket assembly of claim 9, wherein the second material is one of phosphor bronze, beryllium copper, and leaded nickel copper.

12. The socket assembly of claim 11, wherein the second material is at least one of cold-worked and age-hardened.

13. The socket assembly of claim 10, wherein only a portion of the first material is subject to an annealing process to render the portion more ductile.

14. The socket assembly of claim 1, wherein the proximal end of the sleeve extends beyond the proximal end of the spring body.

15. The socket assembly of claim 1, wherein a first conductive material is plated on both sides of the spring body, and a second conductive material is plated only on an inner side of said spring body.

16. The socket assembly of claim 15, wherein the second conductive material is plated only on a distal end of said spring body and a proximal end of said spring body, and not on an area therebetween.

17. The socket assembly of claim 16, wherein the second conductive material is more heavily plated on a proximal end of said spring body than on said distal end of said spring body.

* * * * *